US007454856B2

(12) United States Patent
Passman

(10) Patent No.: US 7,454,856 B2
(45) Date of Patent: Nov. 25, 2008

(54) BADGE HOLDER ON GARMENT CONFIGURATION AND RELATED METHOD

(76) Inventor: Daniel I. Passman, 33819 York Ridge Dr., Farmington Hills, MI (US) 48331

( * ) Notice: Subject to any disclaimer, the term of this patent is extended or adjusted under 35 U.S.C. 154(b) by 61 days.

(21) Appl. No.: 11/561,113

(22) Filed: Nov. 17, 2006

(65) Prior Publication Data

US 2007/0107111 A1 May 17, 2007

Related U.S. Application Data

(60) Provisional application No. 60/737,851, filed on Nov. 17, 2005.

(51) Int. Cl.
*G09F 3/18* (2006.01)

(52) U.S. Cl. ..... 40/661.04; 2/247; D2/857

(58) Field of Classification Search ..... 40/661.04; 2/69, 247; D2/857, 863, 864
See application file for complete search history.

(56) References Cited

U.S. PATENT DOCUMENTS

| | | | | | |
|---|---|---|---|---|---|
| 2,803,829 | A | * | 8/1957 | Tscharner | 40/329 |
| 2,871,485 | A | * | 2/1959 | Greco | 40/586 |
| 2,936,460 | A | * | 5/1960 | Jackson | 40/586 |
| 2,986,743 | A | * | 6/1961 | Eilen | 40/586 |
| 3,055,133 | A | * | 9/1962 | Anderson | 40/586 |
| 3,275,128 | A | * | 9/1966 | Neely | 206/281 |
| 4,259,797 | A | | 4/1981 | Belser | |
| 4,305,215 | A | | 12/1981 | Smith | |
| 4,316,492 | A | | 2/1982 | Plough et al. | |
| 4,581,791 | A | | 4/1986 | Ong | |
| 4,625,337 | A | * | 12/1986 | Zahn | 2/82 |
| 4,869,004 | A | | 9/1989 | Maloney | |
| 4,924,613 | A | * | 5/1990 | Levin | 40/586 |
| 5,073,987 | A | * | 12/1991 | Crosier | 2/144 |
| 5,465,426 | A | * | 11/1995 | Beaton | 2/195.1 |
| 5,472,547 | A | | 12/1995 | McKye et al. | |
| 5,548,847 | A | * | 8/1996 | Spicijaric | 2/209.13 |
| 5,791,076 | A | | 8/1998 | Gailliard | |
| D403,835 | S | * | 1/1999 | Geyer | D2/757 |
| 5,943,698 | A | * | 8/1999 | Blanks, I | 2/69 |
| 5,953,757 | A | * | 9/1999 | Blanks, I | 2/243.1 |
| 5,960,476 | A | * | 10/1999 | Danzy | 2/115 |
| 6,085,449 | A | | 7/2000 | Tsui | |
| 6,226,905 | B1 | | 5/2001 | Osuna | |
| 6,240,568 | B1 | * | 6/2001 | Lee | 2/209.13 |
| 6,470,499 | B1 | * | 10/2002 | Joiner | 2/69 |
| 2004/0133967 | A1 | * | 7/2004 | West | 2/247 |

* cited by examiner

*Primary Examiner*—Gary C Hoge
(74) *Attorney, Agent, or Firm*—Harness, Dickey & Pierce, P.L.C.

(57) ABSTRACT

A garment generally includes a badge that can accessible from an interior of the garment and visible from an exterior of the garment. The garment includes a flap portion formed from a portion of the garment. The flap portion is folded over to form an edge that defines at least a portion of a hole formed in the garment. The garment also includes a generally transparent badge holder having a pocket operable to receive the badge. A fastener attaches the badge holder to the interior of the garment. The badge holder is attached to an interior surface of the garment so that the hole in the garment is disposed on a surface of the badge holder that is opposite the pocket.

19 Claims, 5 Drawing Sheets

BADGE HOLDER ON GARMENT CONFIGURATION AND RELATED METHOD

CROSS REFERENCE TO A RELATED APPLICATION

This application claims the benefit of U.S. Provisional Application No. 60/737,851, filed on Nov. 17, 2005. The disclosure of the above application is hereby incorporated by reference as if fully set forth herein.

FIELD

The present teachings relate to a badge holder affixed to a garment and more specifically relate to a badge holder having a pocket accessible from an interior of the garment, while a portion of the badge holder remains visible from an exterior of the garment.

BACKGROUND

Typically, a badge holder is sewn, glued or clipped to an exterior of a garment. The badge holder can have a pocket that receives a card or a badge. The card or the badge can contain information that can, for example, identify an employee with a name and a company name. The pocket is disposed on and only accessible from an exterior of the garment. Motion of the wearer may cause a portion of the garment to gather or bunch, which may cause the pocket to bulge out from the garment. A bulging pocket that extends from the exterior of the garment may have a higher propensity to catch on or snag certain items that could tear or otherwise damage the pocket. Replacement or repair of pocket may become costly, especially when maintaining a large number of garments.

SUMMARY

The present teachings generally include a garment having a badge that is accessible from an interior of the garment and visible from an exterior of the garment. The garment includes a flap portion formed from a portion of the garment. The flap portion is folded over to form an edge that defines at least a portion of a hole formed in the garment. The garment also includes a generally transparent badge holder having a pocket operable to receive the badge. A fastener attaches the badge holder to the interior of the garment. The badge holder is attached to an interior surface of the garment so that the hole in the garment is disposed on a surface of the badge holder that is opposite the pocket.

Further areas of applicability will become apparent from the description and appended claims provided herein. It should be understood that the description and specific examples are intended for purposes of illustration only and are not intended to limit the scope of the present teachings.

BRIEF DESCRIPTION OF THE DRAWINGS

The present teachings will become more fully understood from the detailed description, the appended claims and the accompanying drawings, wherein:

DETAILED DESCRIPTION

Figure 1A:
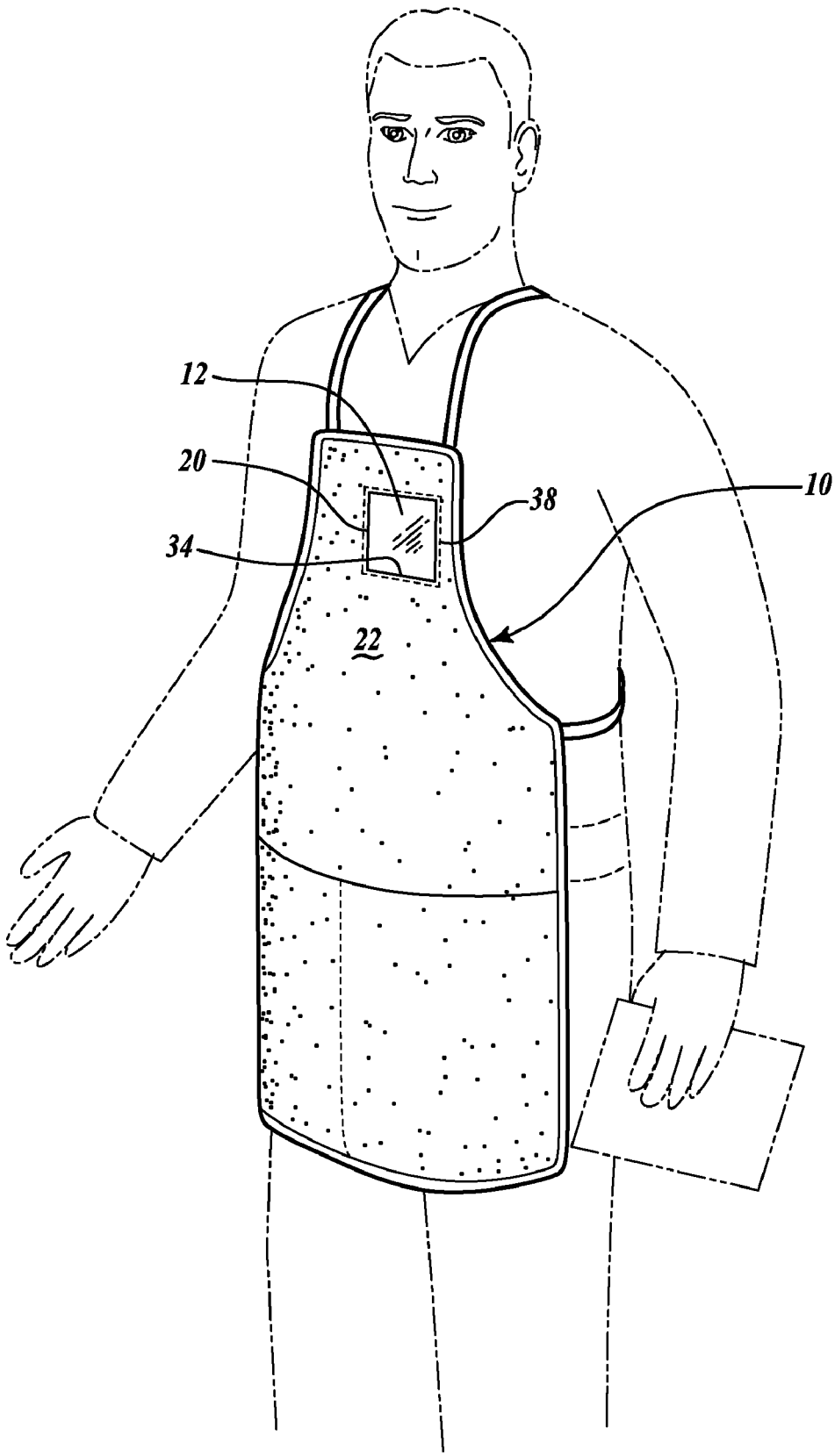
FIG. 1A is a front view of an exterior of a garment with a badge holder affixed to an interior of the garment in accordance with the present teachings.

The following description is merely exemplary in nature and is not intended to limit the present teachings, their application, or uses. It should be understood that throughout the drawings, corresponding reference numerals indicate like or corresponding parts and features.

Figure 1B:
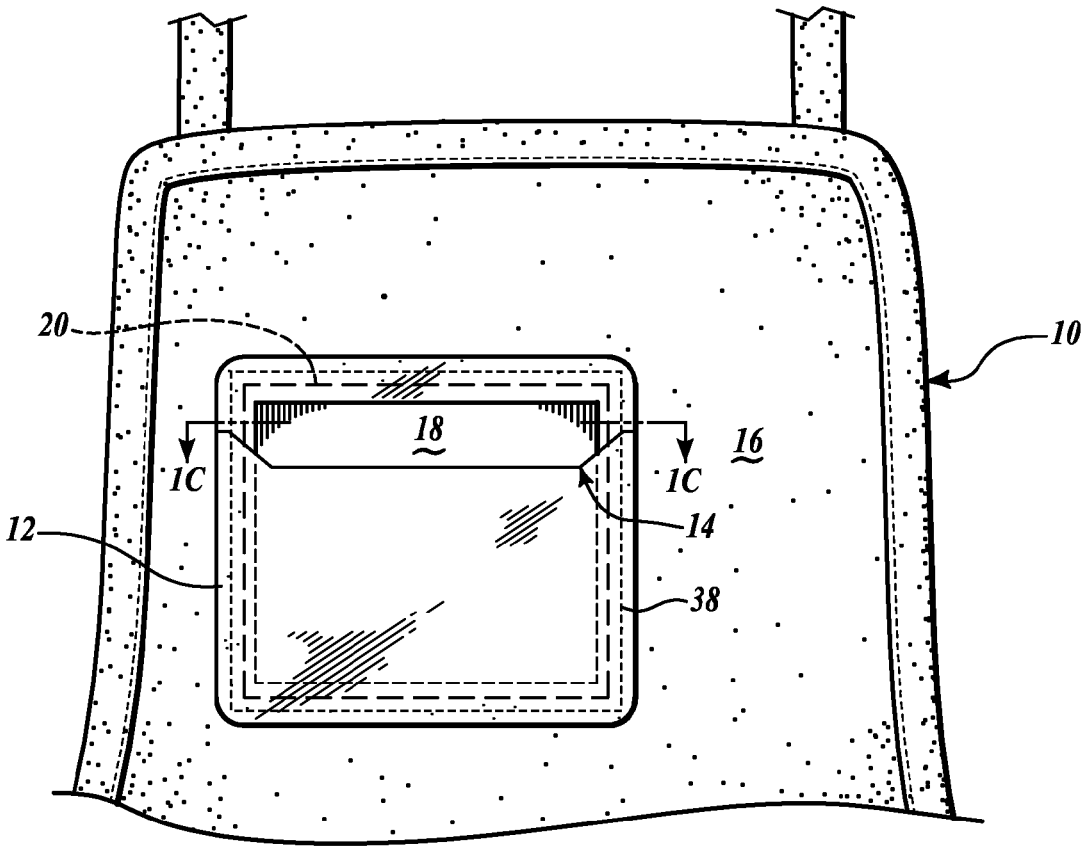
FIG. 1B is a rear view of an interior portion of the garment of FIG. 1A showing the identification badge holder affixed to an interior surface of the garment so that a badge that can be placed into the badge holder is accessible from the interior of the garment and can be viewed from the exterior of the garment in accordance with the present teachings.
Figure 1C:
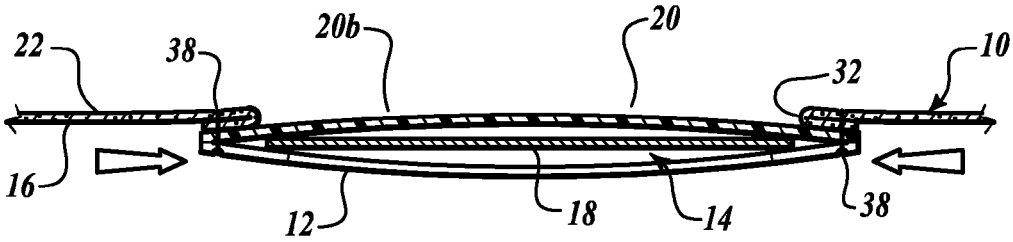
FIG. 1C is a cross-sectional view of the identification badge holder of FIG. 1B showing the badge inserted into the badge holder that is affixed to the interior of the garment and sufficiently compressed to remove the badge.

With reference to FIGS. 1A-1C, the present teachings generally include a garment 10 that can have a badge holder 12 affixed to the garment 10. With reference to FIG. 1B, the badge holder 12 can have a pocket 14 that can be affixed to an interior surface 16 of the garment 10. In this regard, the pocket 14 can be configured to receive a badge 18 (or a card 18, etc.) only from the interior of the garment 10, i.e., the pocket 14 can be configured to only be accessible from the interior surface 16.

With reference to FIGS. 1A, 1B and 1C, the garment 10 can define a hole 20 through which the badge holder 12 may be viewed from the exterior of the garment 10. The hole 20 formed in the garment 10 can be formed in any suitable polygonal shape. In one example, a generally rectangular shape is formed. The rectangular shape of the hole 20 can define a value of a surface area (i.e., a length and a width) that can be less than that of a value of a surface area of the badge holder 12. The value that defines the surface area of the badge holder 12 can be based on an outer periphery of the badge holder 12. In doing so, the hole 20, when viewed from an exterior surface 22 of the garment 10, can frame the badge holder 12, as shown in FIGS. 1A and 3D.

Figure 2:
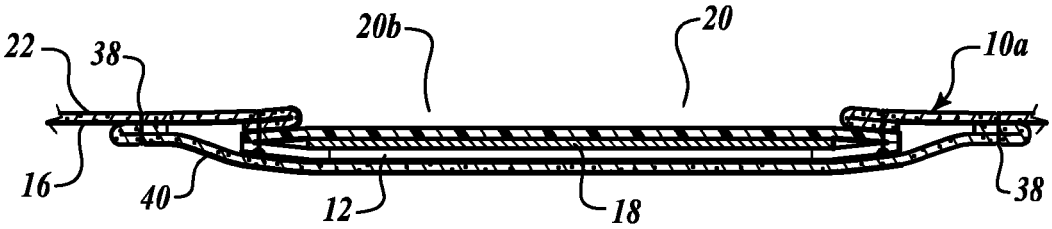
FIG. 2 is similar to FIG. 1C and shows a further aspect of the present teachings that includes a protective cover over the badge holder that connects to the interior surface of the garment.
Figure 3A:
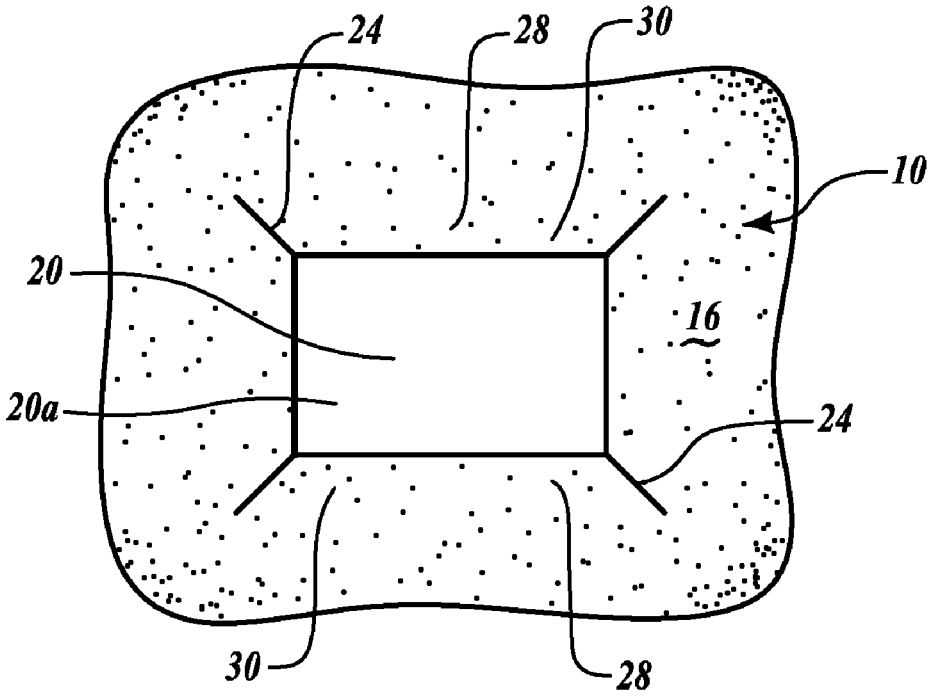
FIG. 3A is a rear view of a portion of an exemplary garment with an initial hole and multiple flap portions formed on the garment constructed in accordance with the present teachings.

With reference to FIG. 3A, the hole 20 in the garment 10 can be formed by initially cutting the rectangular or other suitable polygonal shaped initial hole 20*a* into the garment 10. Multiple channels 24 can be cut in the garment 10. The channels 24 can be formed so as to extend from a periphery 26 of the initial hole 20*a*. By cutting the channels 24 in the garment 10, one or more flap portions 28 can be formed, as shown in FIG. 2B. The flap portions 28 can also be referred to as tab portions 28 or tail portions 28.

Figure 3B:
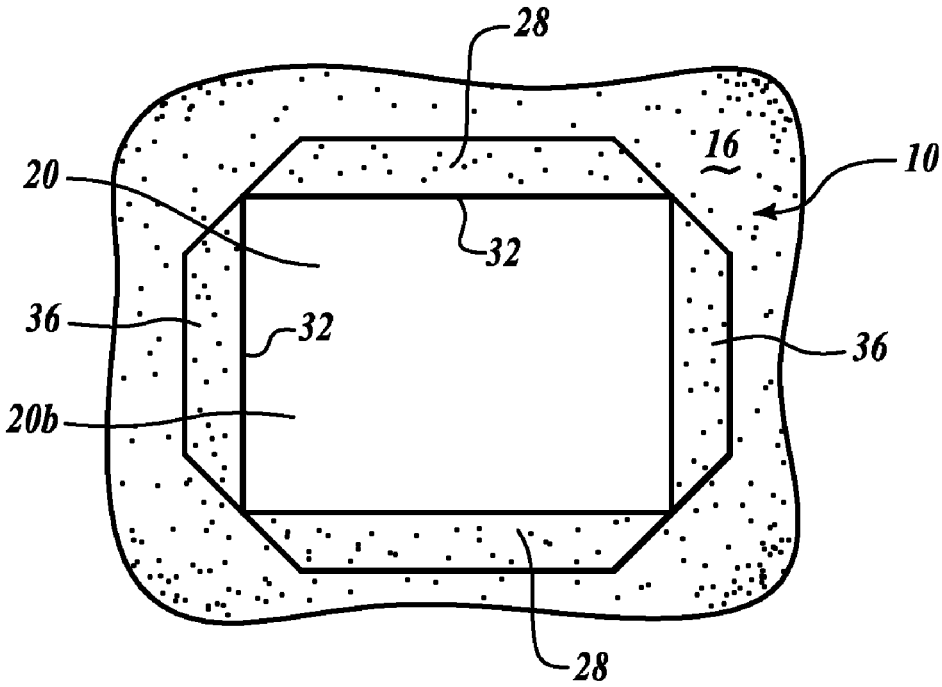
FIG. 3B is similar to FIG. 3A and shows the flap portions folded over to form a finished hole in accordance with the present teachings.

With reference to FIG. 3B, the flap portions 28 can then be folded back such that an interior surface 30 (FIG. 2A) of the flap portions 28 can be folded over to contact a portion of the interior surface 16 of the garment 10 that is adjacent to the hole 20. In this regard, the flap portions 28 can form an edge portion 32. The edge portion 32 can define a portion of the finished hole 20*b* (FIG. 3D) on the garment 10. It will be appreciated in light of the disclosure that the edge portion 32 can form a finished, hemmed or otherwise neat edge that can define a border 34 (FIG. 3D) that can frame the badge holder 12 as viewed from the exterior surface 22 of the garment 10.

Figure 3C:
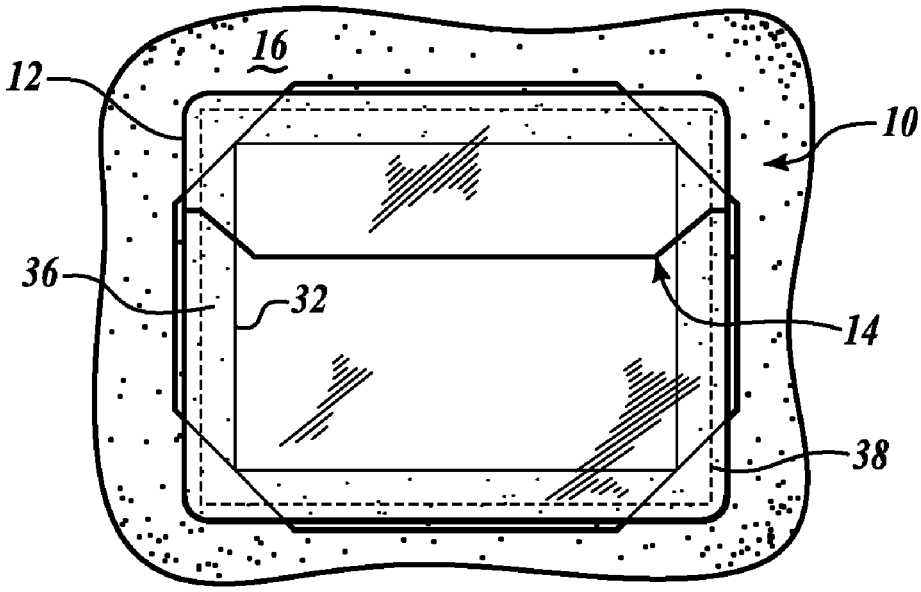
FIG. 3C is similar to FIG. 3B and shows a badge holder affixed to an interior of the garment so that the badge is accessible and/or replaceable from the interior of the garment but still visible from the exterior of the garment in accordance with the present teachings.
Figure 3D:
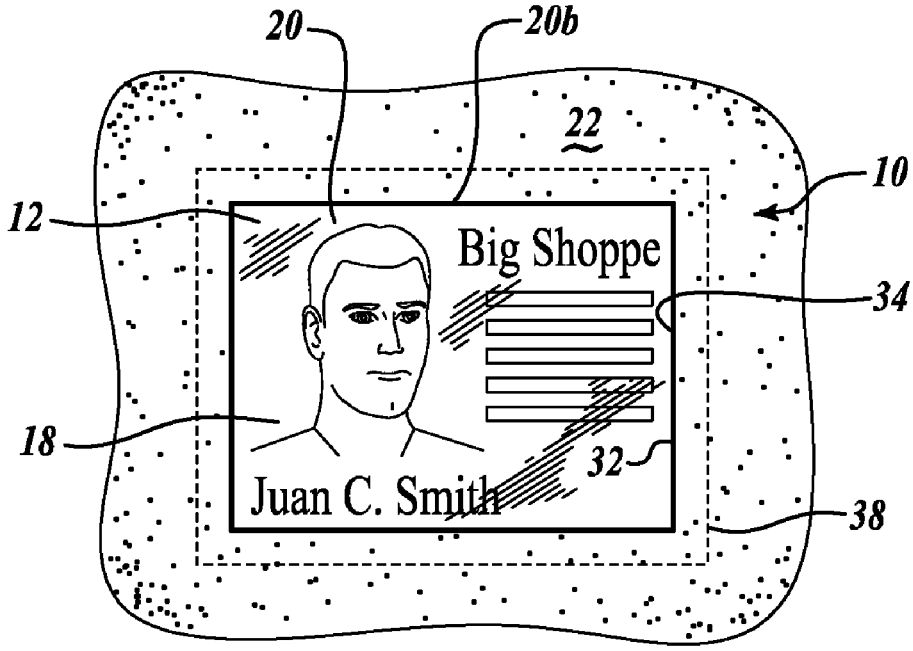
FIG. 3D is a front view of the garment of FIG. 3C showing the badge through the finished hole in the exterior of the garment that can frame the badge in the badge holder that is affixed to the interior of the garment.

With reference to FIG. 3C, the badge holder 12 can be placed in contact with an exterior surface 36 (FIG. 2B) of the flap portions 28 and thus ultimately against the garment 10. The badge holder 12 can also be affixed to a portion of the garment 10 in addition to the flap portions 28, as shown in FIG. 1C. Specifically, a fastener 38 can secure the badge holder 12 against the flap portion 28 and ultimately against the portion of the garment 10 near the flap portions 28. The fastener 38 can define one or more threads for stitching, one or more staples, one or more clips, one or more adhesives, other suitable fasteners and one or more combinations thereof. The fastener 38 can connect the badge holder 12 to the garment 10 so that the flap portions 28 are coupled between a portion of the badge holder 12 and a portion of the interior surface 16 of the garment 10.

With the badge holder 12 installed on the garment 10, the pocket 14 of the badge holder 12, into which the badge 18 can be placed, can be configured to be accessible from the interior surface 16 of the garment 10. From the exterior surface 22 of the garment 10, a portion of the badge holder 12 can remain visible so as to view the badge 18 contained within the badge holder 12 from the exterior of the garment 10. In one example, the finished edge portions 32 that can serve as the border 34 around the badge holder 12. The size and shape of the initial hole 20*a*, the finished hole 20*b* and the border 34 formed from the garment 10 can vary in size and configuration and can be (or need not be) complimentary to the size and configuration of the badge holder 12.

In one example, the badge holder 12 can have an exemplary rectangular size of about four and one-quarter inches by about three and three-quarter inches. One suitable example of the badge holder 12 and the badge 18 are readily available under the Avery® brand. Moreover, the thickness of the flap portions 28 can be about a quarter of an inch. In this regard, the thickness of the flap portions 28 can be defined from the finished edge portion 32 to an original edge of the flap portion 28, i.e., the edge that formed the initial hole 20*a* (FIG. 2A).

In a further example and with reference to FIG. 2, a cover 40 can be attached over the badge holder 12 on the interior surface 16 of a garment 10*a* so as to provide a softer material (relative to the badge holder 12) over the badge holder 12. In doing so, the garment 10 may be more comfortable to the user because the cover 40 can be shown to at least shield the user from the badge holder 12.

Returning to FIG. 3D, the badge 18 that can be placed in the pocket 14 of the badge holder 12 can be made of various suitable materials such as cardboard, plastic, etc. The badge 18 can contain, for example, a name of the user, a company name, a company logo, etc.

Figure 4:
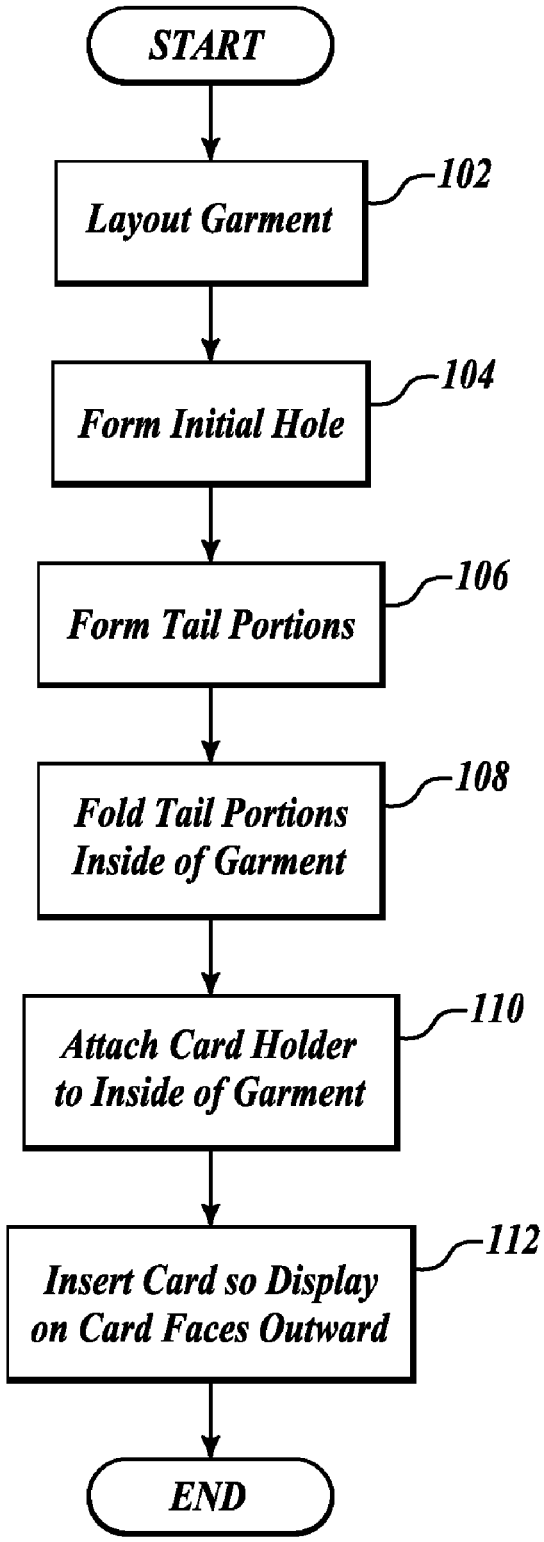
FIG. 4 is a flow chart showing an exemplary method of forming a finished hole in the exterior of the garment and attaching the badge holder to the interior of the garment in accordance with the present teachings.

With reference to FIG. 4, an exemplary method is illustrated. The method begins with 102. In 102, the garment 10 is laid out in preparation for forming a hole 20. In one example, a jig or a backing can be designed and/or configured to hold the garment 10 (e.g., a smock or an apron as shown in FIG. 1A) and to receive a cutting tool that can cut the initial hole 20*a* in the garment 10. It will be appreciated in light of the disclosure that the garment 10 must be kept generally flat and held tight during the operation.

In 104, the initial hole 20*a* is formed in the garment 10. A cutting die and press or other suitable cutting mechanism may be used to form the initial hole 20*a* in the garment 10. The initial hole 20*a* may be any suitable polygonal shape and may, for example, be a rectangular shape. It will be appreciated that other forms of cutting may be used such as scissors, lasers, reciprocating blades, other suitable cutting mechanisms and combinations thereof.

In 106, the flap portions 28 are formed from a portion of the garment 10 adjacent to the initial hole 20*a* formed in 104 above. The flap portions 28 can be formed by cutting the channels 24 that can extend from the periphery 26 of the initial hole formed in 104. It will be appreciated in light of the disclosure that the channels 24 can be formed in a separate process or in combination with forming the initial hole 20*a* and, therefore, in a single process.

In 108, the flap portions 28 can be folded over to contact the interior surface 16 of the garment 10. Specifically, the interior surface 30 of the flap portions 28 can be folded over to contact the interior surface 16 of the garment 10. The edge portion 32 can be formed at the fold of the flap portion 28. The edge portion 32 can define a periphery that can define the border 34 of the hole 20 (i.e., the finished hole 20*b*) formed on the garment 10.

In 110, the badge holder 12 can be affixed to the interior surface 16 of the garment 10. In one example, the fastener 38 such as thread can be used in a top stitch or other suitable stitch to affix the badge holder 12 directly to the flap portions 28 and additionally to the interior surface 16 of the garment 10 near the hole 20. In this regard, a portion of the badge holder 12 can be framed by the border 34 and thus can remain visible from the exterior surface 22 of the garment 10. In addition, the pocket 14 of the badge holder 12 can remain accessible from the interior surface 16 of the garment 10.

In 112, the badge 18 can be placed in the badge holder 12. It will be appreciated that the card 18 or the badge 18 can be placed in the pocket 14 which can be accessible from the interior surface 16 of the garment 10 while the badge holder 12 and the badge 18 therein can remain visible from the exterior surface 22 of the garment 10. By way of the above example, the border 34 can frame the information that can be displayed on the badge 18 so that is visible from the exterior of the garment 10. From 112, the method ends.

The badge holder 12 as affixed to the garment 10 in accordance with the present teachings can be shown to avoid the problem of having the pocket 14 tear away from a remaining portion of the badge holder 12. It can be shown that affixing the badge holder 12 to the interior surface 16 of the garment 10 can protect the pocket 14 from tearing or other damage but the pocket 14 can still be accessible from the interior of the garment 10 to, for example, exchange the badge 18 from the pocket 14. Moreover, the edge 34 can provide a finished (i.e., hemmed) edge to frame the badge 18 in the badge holder 12.

While specific aspects have been described in this specification and illustrated in the drawings, it will be understood by those skilled in the art that various changes can be made and equivalents can be substituted for elements thereof without departing from the scope of the present teachings, as defined in the claims. Furthermore, the mixing and matching of features, elements and/or functions between various aspects of the present teachings may be expressly contemplated herein so that one skilled in the art will appreciate from the present teachings that features, elements and/or functions of one aspect of the present teachings may be incorporated into another aspect, as appropriate, unless described otherwise above. Moreover, many modifications may be made to adapt a particular situation, configuration or material to the present teachings without departing from the essential scope thereof. Therefore, it may be intended that the present teachings not be limited to the particular aspects illustrated by the drawings and described in the specification as the best mode presently contemplated for carrying out the present teachings but that the scope of the present teachings will include many aspects and examples following within the foregoing description and the appended claims.

What is claimed is:

1. A garment having a badge that can identify a wearer of the garment, the badge is accessible from an interior of the garment and is visible from an exterior of the garment, the garment comprising:

a flap portion formed from a portion of the garment that defines a rectangular hole, said flap portion folded over to form an edge that defines at least a portion of said rectangular hole formed in the garment;

a generally transparent badge holder having an octagonal periphery, said generally transparent badge holder having an exterior panel and an interior panel that form a pocket operable to receive the badge, said interior and exterior panels each having an edge that cooperates to form an opening of said pocket, wherein said edge of said interior panel is at least in part disposed across said rectangular hole formed in said portion of the garment and disposed below said edge of said exterior panel;

a fastener that attaches said generally transparent badge holder to the interior of the garment by coupling said flap portion between a portion of said badge holder and said portion of the garment near said rectangular hole, wherein said generally transparent badge holder is attached to the interior of the garment so that said rectangular hole in the garment is disposed on said exterior panel of said badge holder and is opposite said pocket.

2. The garment of claim 1 wherein said fastener is one or more threads for stitching, staples, clips, adhesives and combinations thereof.

3. The garment of claim 1 wherein said edge that at least partially defines said rectangular hole in the garment is hemmed and at least partially frames a portion of the badge in said badge holder.

4. The garment of claim 1 wherein said rectangular hole in the garment is sized to fit entirely within said octagonal periphery of said generally transparent badge holder.

5. The garment of claim 1 further comprising a cover that extends over said interior panel of said generally transparent badge holder and couples to an interior surface of the garment.

6. The garment of claim 1 wherein an interior surface of said flap portion is folded over onto an interior surface of the garment to form said edge of said rectangular hole in the garment.

7. The garment of claim 1 wherein a member of the garment is operable to extend around a torso of the wearer and a member of the garment is operable to extend around a neck of the wearer.

8. The garment of claim 1 wherein said pocket of said generally transparent badge holder only accepts one badge.

9. A garment having an interior, an exterior and a badge visible from the exterior of the garment that can identify a wearer of the garment, the garment comprising:

a portion of the garment that defines a rectangular hole;

a portion of the garment that is operable to extend around a torso of the wearer;

a portion of the garment that is operable to extend around a neck of the wearer;

a badge holder having an octagonal periphery, said badge holder having a pocket that is operable to accept the badge, said badge holder having an exterior panel and an interior panel that form said pocket, said interior and exterior panels each having an edge that cooperates to form an opening of said pocket, wherein said edge of said interior panel is at least in part disposed below said edge of said exterior panel.

10. The garment of claim 9 wherein said badge holder is fixed to the garment with a fastener that attaches said badge holder to the interior of the garment so that said rectangular hole in the garment is disposed on said exterior panel of said badge holder.

11. The garment of claim 10 wherein said fastener is one or more threads for stitching, staples, clips, adhesives and combinations thereof.

12. The garment of claim 10 wherein said fastener couples a flap portion formed from the garment between a portion of said badge holder and said portion of the garment near said rectangular hole.

13. The garment of claim 9 further comprising a cover that extends over said interior face of said badge holder and couples to the interior of the garment.

14. The garment of claim 9 wherein said edge of said interior panel is at least in part disposed across said rectangular hole formed in said portion of the garment.

15. The garment of claim 9 wherein said pocket of said generally transparent badge holder only accepts one badge.

16. A method of providing a transparent badge holder on an interior of a garment so that a pocket of the transparent badge holder that accepts a badge is accessible to a wearer from the interior of the garment and the badge is visible from an exterior of the garment, the method comprising:

cutting an initial rectangular hole in the garment to form a flap portion having an exterior face and an interior face;

folding said interior face over against the interior of the garment, wherein an edge of said flap portion defines at least in part a portion of a periphery of a finished rectangular hole;

providing said transparent badge holder, said transparent badge holder having an octagonal periphery, an interior wall, and an exterior wall, said interior wall and said exterior wall cooperating to form the pocket;

disposing a top edge of said interior wall of the pocket below a top edge of said exterior wall of the pocket;

affixing the transparent badge holder to said exterior face of the said flap portion and the garment adjacent said finished rectangular hole;

extending a portion of the garment around a torso of the wearer;

extending a portion of the garment around a neck of the wearer.

17. The method of claim 16 wherein said cutting of said initial rectangular hole in the garment includes cutting at least two channels while cutting said initial rectangular hole.

18. The method of claim 16 wherein said affixing of the transparent badge holder to the interior of the garment includes hemming said flap portion to provide said edge in a finished condition.

19. The method of claim 16 wherein said affixing of the badge holder to the interior of the garment includes stitching through said badge holder, said flap portion and a portion of the garment near said finished rectangular hole.

* * * * *